United States Patent [19]

Mahanay et al.

[11] Patent Number: 4,639,202

[45] Date of Patent: Jan. 27, 1987

[54] GEROTOR DEVICE WITH DUAL VALVING PLATES

[76] Inventors: Joseph W. Mahanay, 12018 Mississippi Dr., Champlin, Minn. 55316; Lester D. Savage, 1010 W. Stroughton St., Urbana, Ill. 61801

[21] Appl. No.: 698,906

[22] Filed: Feb. 6, 1985

[51] Int. Cl.[4] ..... F01C 1/10; F01C 11/00; F03C 2/08; F04B 17/00

[52] U.S. Cl. ..... 418/59; 418/61 B; 417/348; 417/352; 417/355; 417/406; 384/447; 384/548

[58] Field of Search ..... 418/59, 61 B, 151; 417/348, 352, 355, 392, 405, 406; 384/447, 548

[56] References Cited

U.S. PATENT DOCUMENTS

| | | | |
|---|---|---|---|
| 3,377,873 | 4/1968 | Patterson, Jr. | 418/151 |
| 3,431,863 | 3/1969 | Waldorff | 418/61 B |
| 3,453,966 | 7/1969 | Eddy | 418/59 |
| 3,490,383 | 1/1970 | Parrett | 418/61 B |
| 3,547,565 | 12/1970 | Eddy | 418/61 B |
| 3,910,733 | 10/1975 | Grove | 418/61 B |
| 3,979,167 | 9/1976 | Grove | 418/61 B |
| 4,380,420 | 4/1983 | Wusthof et al. | 418/61 B |

*Primary Examiner*—John J. Vrablik

[57] ABSTRACT

Apparatus responsive to fluid pressures and capable of providing fluid under pressure to provide a unit which may selectively be used as a fluid motor or a fluid driven motor pump unit depending upon fluid directing and control structures and with minimal modifications to achieve the various desired functions. The unit consists of a pair of radially arranged units which units are known in the art as gerotors and which therefore includes a shaft for mounting or driving a first gear rotor of a first size, a rotor ring which is provided for both orbital and rotational movement with respect to the first gear rotor and with respect to a stationary ring gear surrounding the rotor ring. Valving plates including stationary and moving plates are provided to control fluid flow either between chambers formed by the various gear members and rotor ring for parallel flow when the unit is operating as a motor or individual chamber flow when the unit is operated as a motor pump. The rotation and rotation and orbital movements of the various members provides expanding and contracting fluid chambers for fluid flow and thus operation of the apparatus in its selected mode. A uniqueness of the apparatus lies in the utilization of plate valving to eliminate or reduce normally faced sealing problems and to reduce size of the unit in comparison to gerotor units which are joined in a longitudinal fashion.

11 Claims, 17 Drawing Figures

GEROTOR DEVICE WITH DUAL VALVING PLATES

FIELD OF THE INVENTION

The invention relates generally to fluid driving and driven apparatus for conversion of flow of fluids under pressure to mechanical rotation and flow of fluids under pressure to drive other fluids and remotely to apparatus for metering other fluids and more specifically to a fluid apparatus which provides a pair of gerotor units in radially adjacent position.

SHORT SUMMARY OF THE INVENTION

A radially oriented, double gerotor fluid device having capabilities to operate as a fluid driven motor or a motor-pump combination with selective output characteristics and further to operate as a metering device dependent upon various component selectivity. The unit includes a drivable or mounting shaft having a first gear rotor and first valving plate thereon, a second rotor ring having both internal and external lobes and a third, stationary ring gear and also including an external, stationary valve plate and a valve plate movable with the rotor ring for rotation or a combinationof rotation and orbital movement with the rotor ring. All of these units are contained within a pressure housing and communication and flow control means are provided for proper direction of flow, dependent upon the selected operation for initial fluid direction to the valve plates and receipt of exhausted and driven fluid. The first and third gear and ring are similarly provided with lobes to provide, in combination with the rotor ring, a series of contracting and expanding chambers to drive and be driven by the fluid.

The unit also is provided with counterbalance to offset the orbital movement of the rotor ring and thereby provide a smoothly operating unit.

The coordination of the valving plates, particularly the orbiting or selectively rotating plate in combination with the stationary plates provides for smooth fluid flow and the design of the unit, being radial in arrangement rather than the ordinary axial or longitudinal arrangement for joined gerotors is unique.

BACKGROUND AND OBJECTS OF THE INVENTION

The applicants are well aware of the prior gerotor art. In all of his exposure and searches, the art has failed to reveal any radially arranged double gerotor units. It is acknowledged that gerotors have been arranged in axial or longitudinal alignment but no items of this nature have been found incorporating the applicant's concepts. Pertinent, although substantially different in operation and concepts, are devices described and claimed in U.S. Pat. Nos. Re. 26,383 to Huber and 3,574,489 to Pierrat and in publications by the W. H. Nichols Co. in *Design News,* 8-18-80 and a non-published bulletin both of which relate to internally generated rotor sets (IGRs). The devices illustrated and discussed in such articles and patents are clearly distinct from the subject matter disclosed herein.

It is therefore an object of the applicant's invention to provide a double gerotor device which is relatively simple in its construction and which provides for dual gerotor operation with alignment of the rotors being radial.

It is a further object of the applicants' invention to provide a double gerotor device which provides for efficient, straight through valving which includes the benefits of larger valving ports, larger sealing lands and which prevents cross porting.

It is still a further object of the applicants' invention to provide a double gerotor device which, through its design permits utilization thereof as a motor, motor-pump or metering unit.

It is still a further object of the applicants' invention to provide a double gerotor device which will hold loads without hydraulic pressure and will give precise positioning as well as precise stop-start characteristics.

It is still a further object of the applicants' invention to provide a double gerotor device which, due to its inherent design, eliminates "dogbone" linkages between the orbiting rotor and the rotating motor shaft.

These and other objects and advantages of the applicants' device will more clearly appear from a consideration of the accompanying description made in conjunction with the accompanying drawings.

DESCRIPTION OF THE DEVICE

In accordance with the accompanying drawings, the rotary motion fluid apparatus or device embodying the concepts of the applicant's invention is generally designated 20 and is, in the primary form illustrated in FIGS. 1 through 15, described as a fluid driven motor. It should be understood that the applicant has provided a rotary motion fluid device and inherent therein are certain characteristics which allow for modifications of the unit to allow the same to function as a motor-pump combination and further, alternatively, as a metering device. In each instance, although the basic unit remains the same, minimal structural and fluid control changes allow such variation without departing from the scope of the invention.

An important consideration that must be kept in mind is that the term fluids includes other than liquids.

Another important aspect of the description of the invention is that minimal concern has been directed to the effective sealing procedures and structures utilized and required for true operation of such units. The applicant is well aware of the requirements of sealing the various portions of the unit for proper power delivery and fluid transfer but in various instances within this application, to simplify the description while maintaining clarity, sealing techniques and structures are not totally described except where to eliminate such description would prevent one skilled in the art from utilizing the teachings herein.

As illustrated, the unit 20 is designed and constructed for a double gerotor unit. A double gerotor is defined as a pair of gerotor members arranged in radially adjacent position as compared to singular units which may be arranged in tandem or axially aligned fashion.

The unit 20 consists of and includes a housing having a generally cylindrical shaped outer casing 21*a*, a pair of end members 21*b*, 21*c* to close the end of the casing 21*a* with sealing members 21*d*, 21*e* arranged therebetween with attachment members such as the threaded fasteners 21*f* securing such ends 21*b*, 21*c* to the casing 21*a*. Fluid under pressure is introduced to the closed housing through inlet 21*g* and is exhausted therefrom from outlet 21*h*. As further illustrated, mounting bosses 21*i*, 21*j* are provided centrally of end plates 21*b*, 21*c* for the rotational mounting of a shaft 22 therein. Bearings 23*a*, 23*b* and seals 23*c*, 23*d* are similarly provided within the bosses 21*i*, 21*j* for rotation of the shaft 22 for, if the unit is being operated as a double, fluid driven motor, powered output of the shaft 22.

Figure 1:
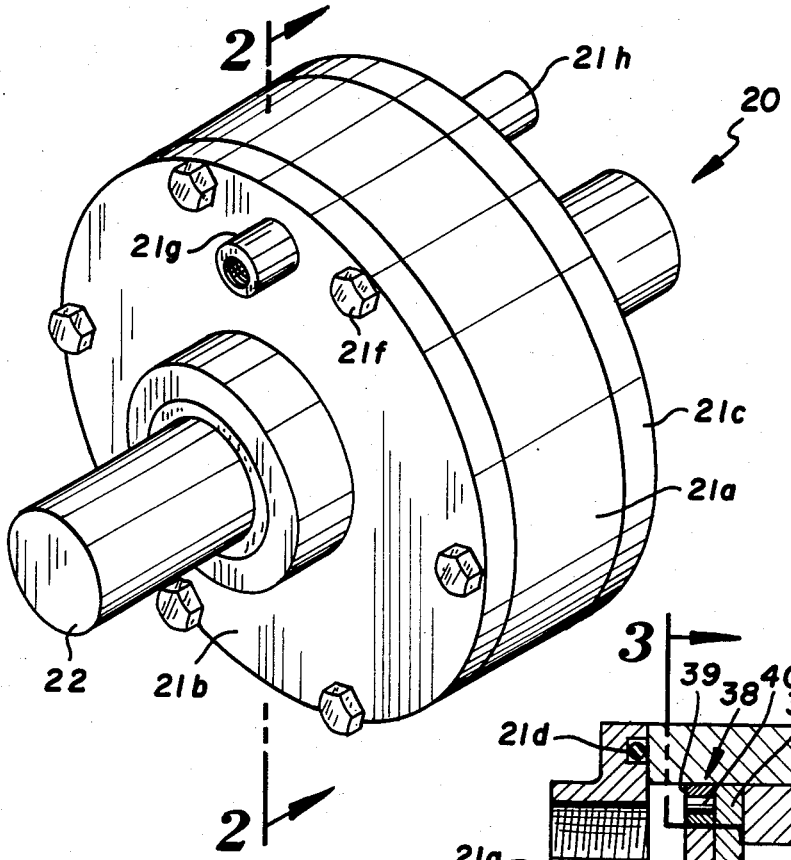
FIG. 1 is a simple perspective drawing of a double gerotor device embodying the concepts of the applicants' invention.
Figure 2:
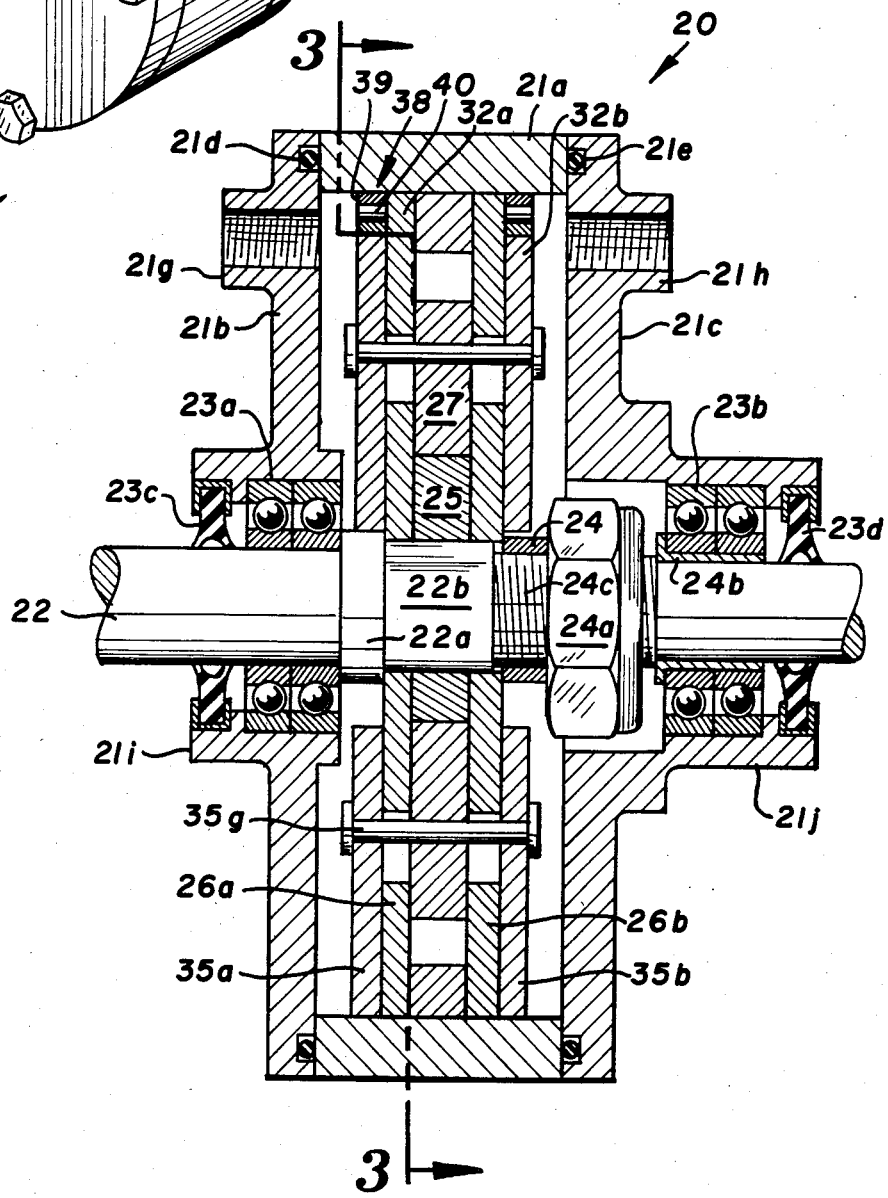
FIG. 2 is a transverse cross section taken substantially along line 2—2 of FIG. 1.
Figure 3:
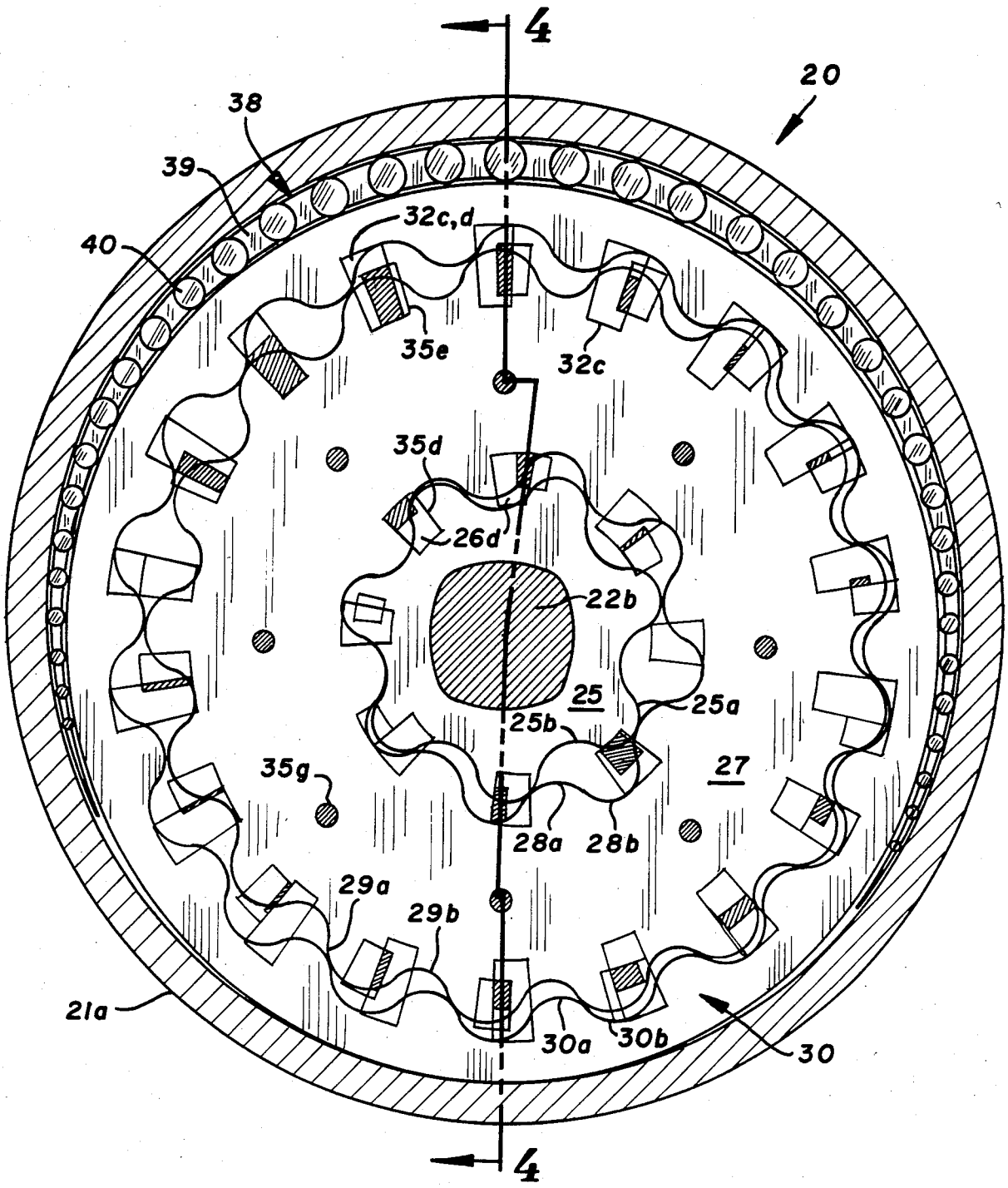
FIG. 3 is a radially transverse section taken substantially along Line 3—3 of FIG. 2.
Figure 7:
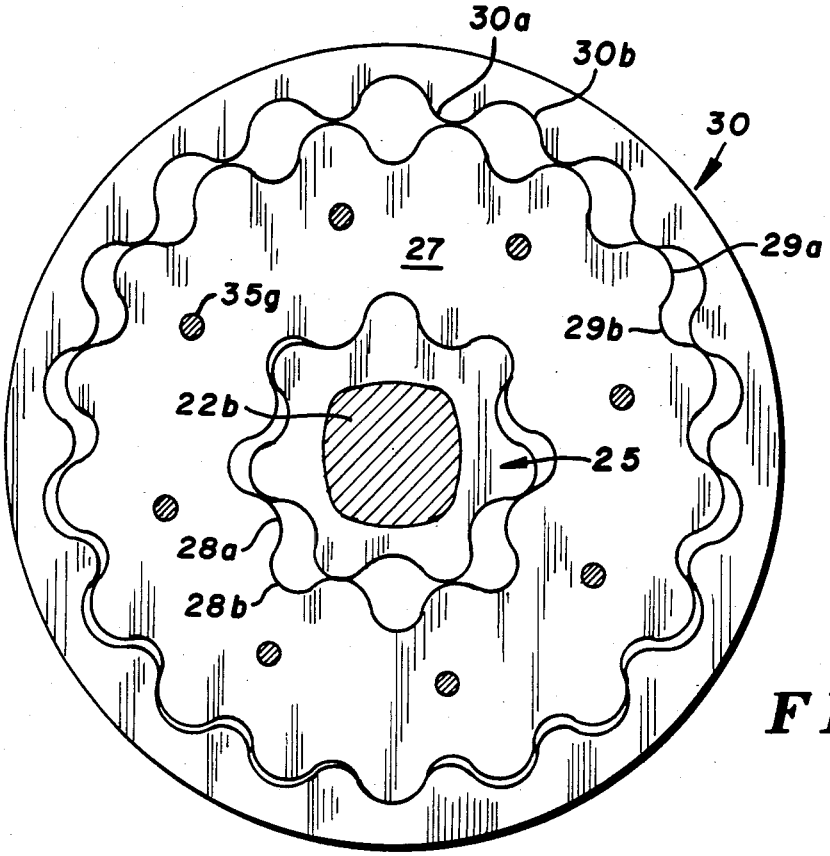
FIG. 7 is a cross section taken substantially along Line 7—7 of FIG. 4.

As particularly illustrated in FIG. 2 and further in FIG. 7, a typical driving or driven, central portion of shaft 22 would include a first abutting and locating shoulder 22*a*, a gear ring mounting section 22*b*, a threaded longitudinal portion 22*c* for sliding movement of a locator ring 24 and a tightening nut 24*a* acting against the ring 24 for positioning of the various components of the unit along shaft 22. A bearing surface member 24*b* may also be provided in spaced relation to the adjustment nut 24*a*, as shown.

Figure 7A:
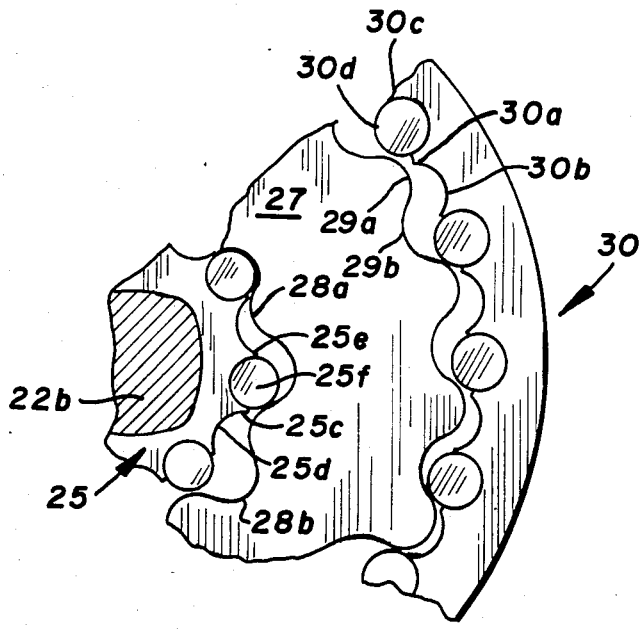
FIG. 7*a* a portion of FIG. 7 illustrating a modification of the interacting lobes of the various gearing sections of the unit.
Figure 8:
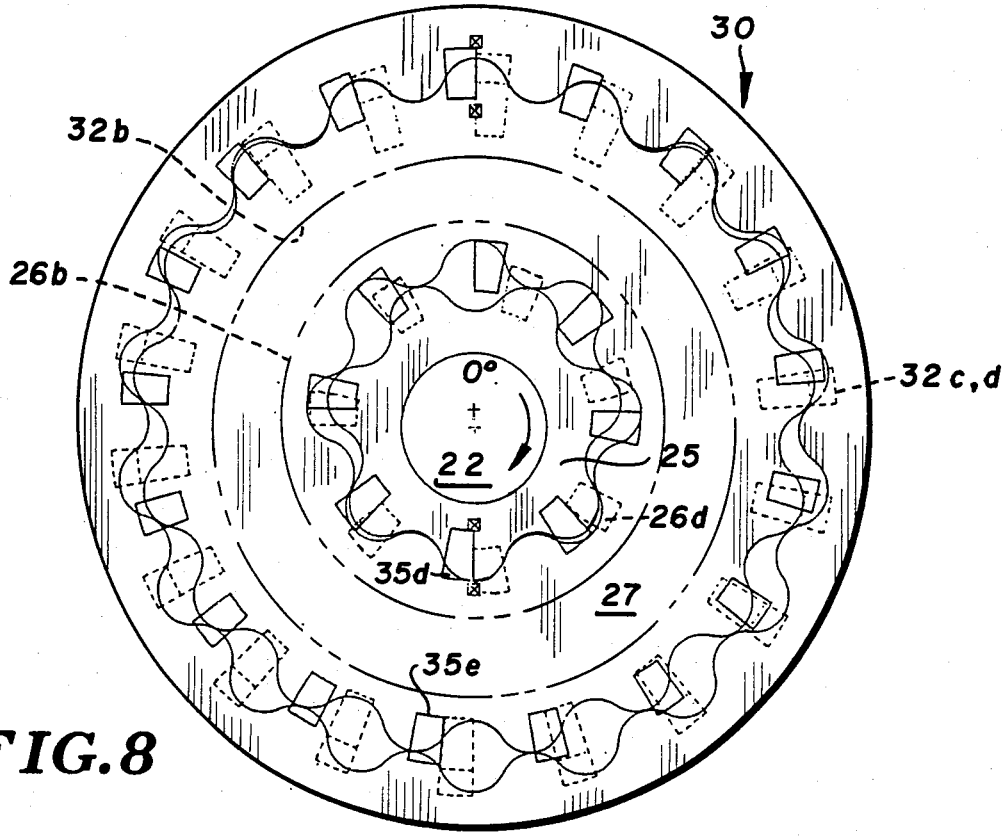
FIGS. 8 through 15 are overlay cross sections taken substantially along their respective designation lines of FIG. 4 to illustrate the various elements of the unit; the overlays showing Intake positions in FIGS. 8, 10, 12 and 14 and Exhaust positions in FIGS. 9, 11, 13 and 15 with each successive Figure illustrating the members in advancing 90° positions; and, FIG. 16 is a cross section similar to FIG. 4 but showing the same in a modified form for use a motor-pump combination.
Figure 9:
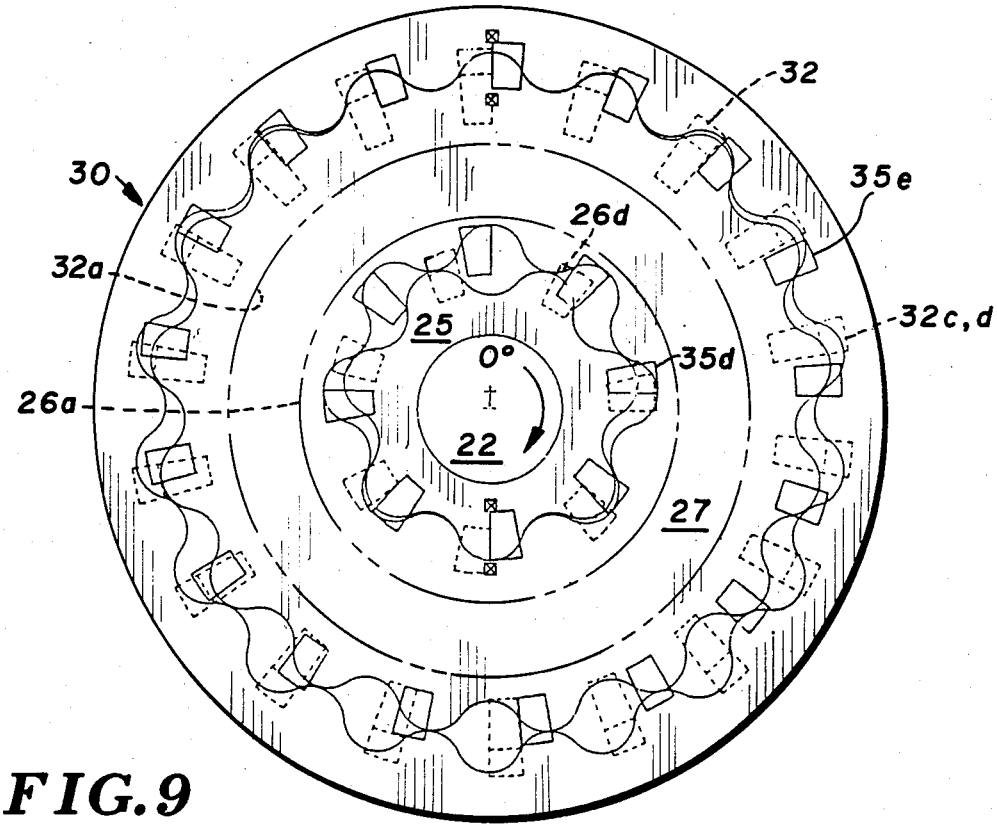
Figure 10:
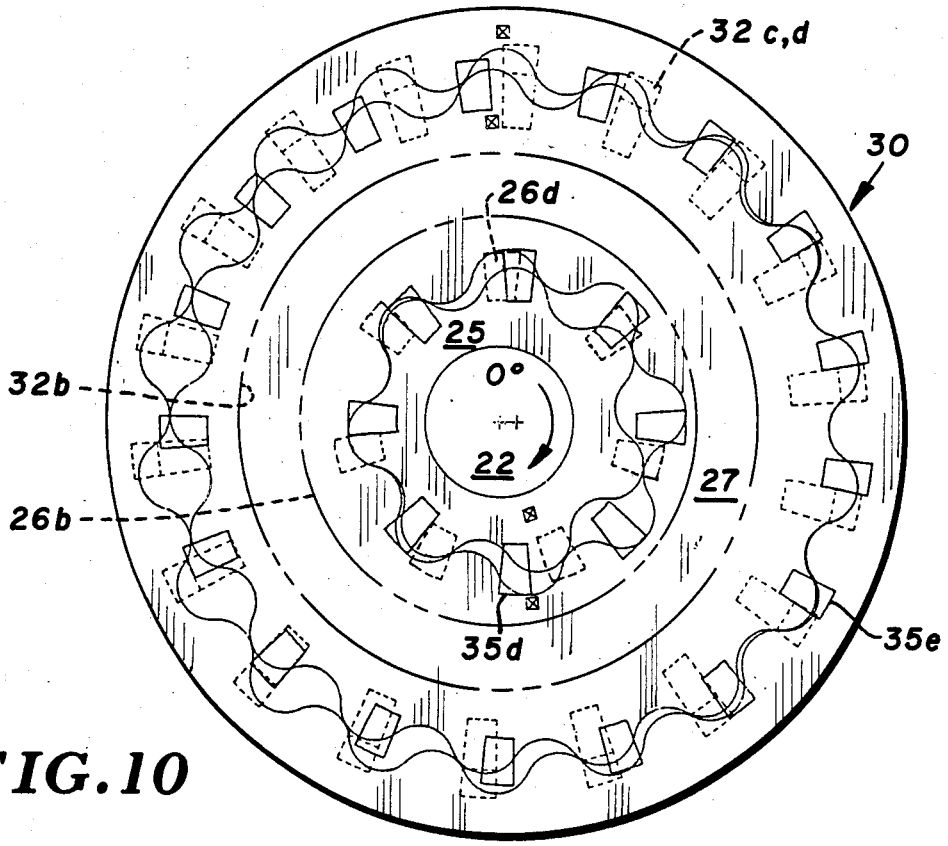
Figure 11:
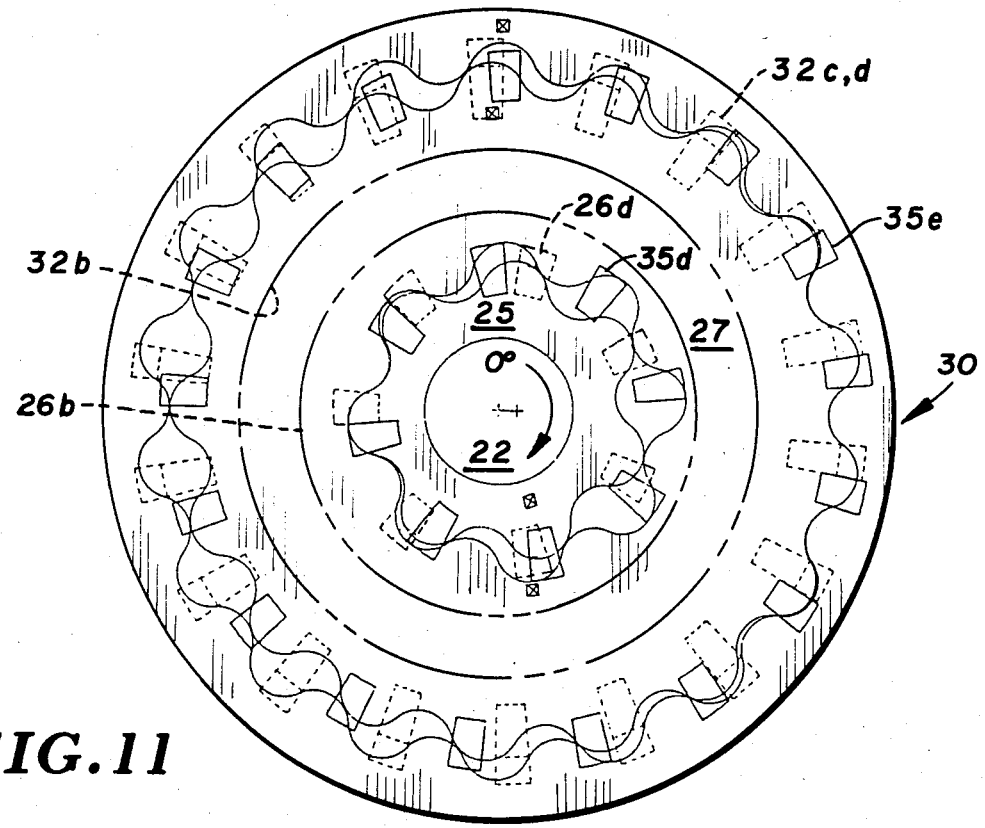
Figure 12:
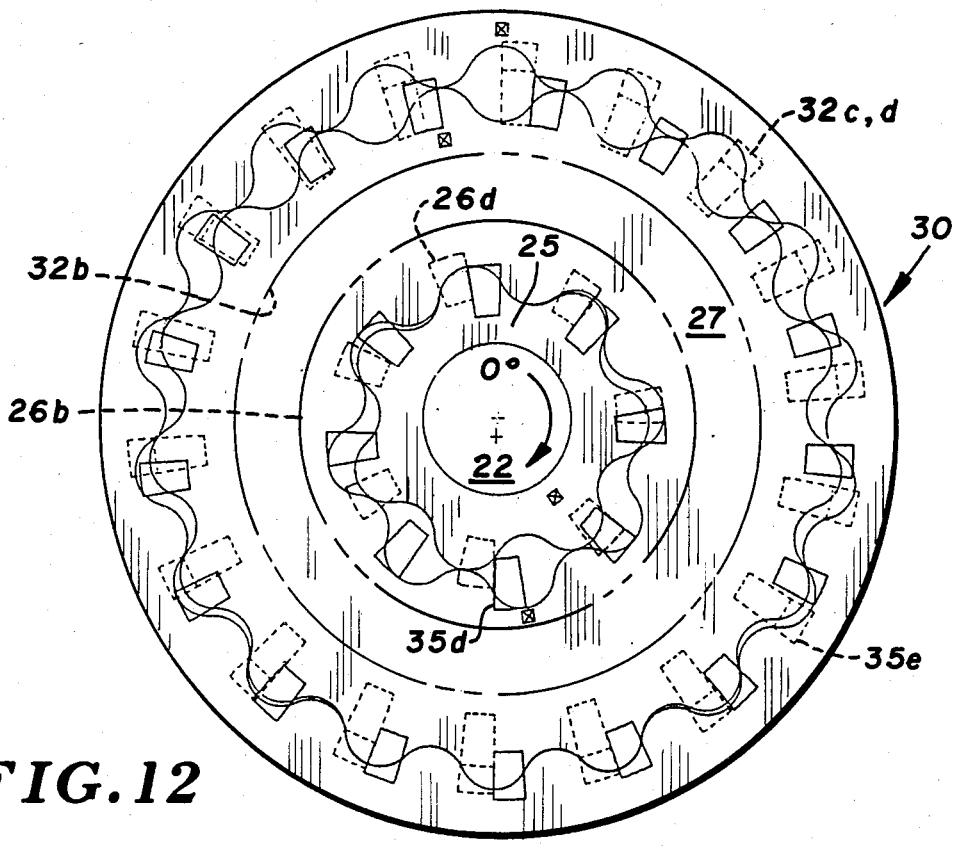
Figure 13:
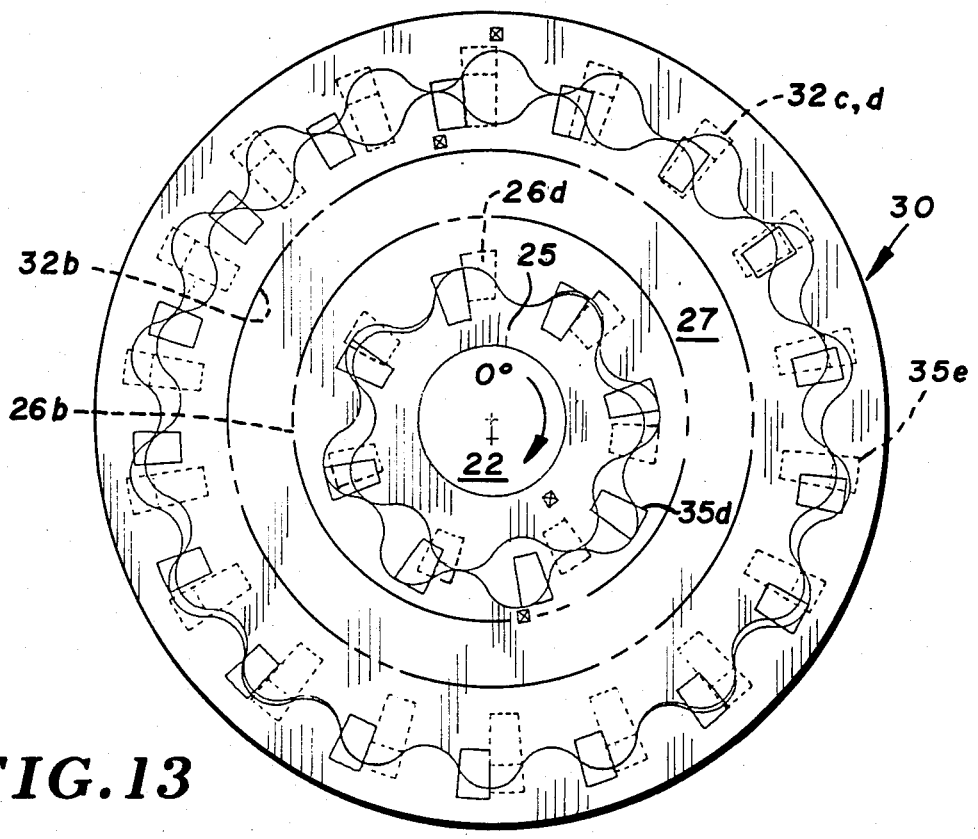
Figure 14:
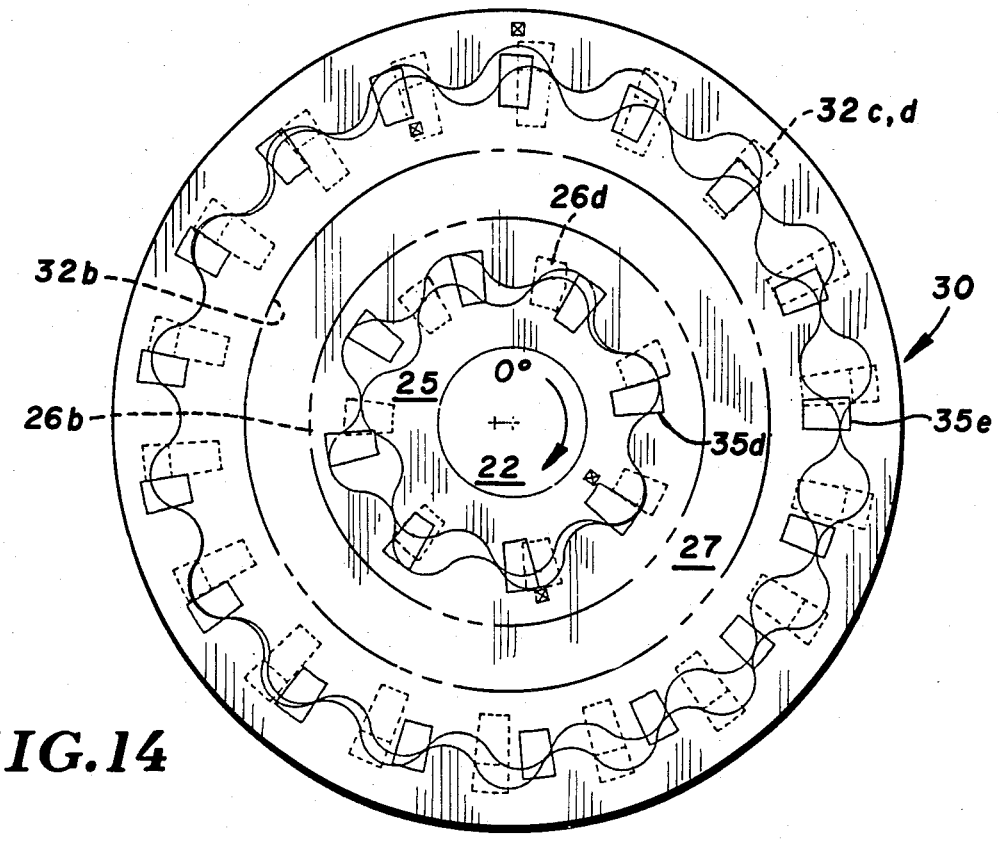
Figure 15:
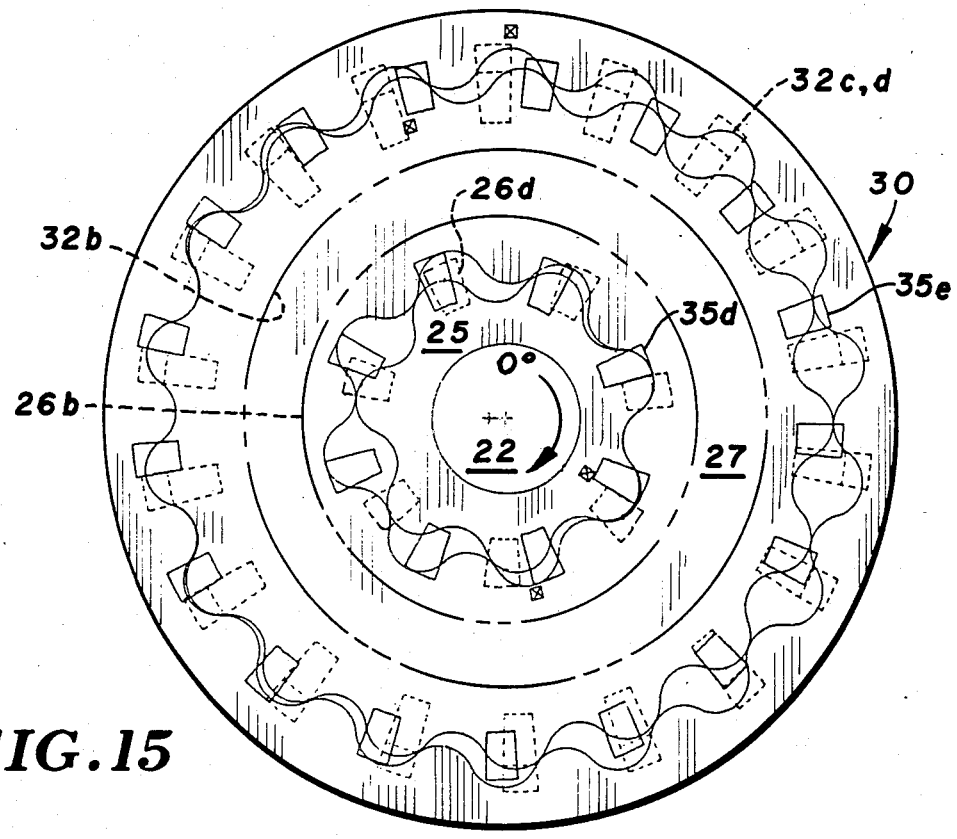

As illustrated in FIG. 7, the gear ring mounting section 22*b* is multisided in configuration for proper mounting of the ring gear 25 thereon. Obviously such a shape in combination with the passage through gear 25 provides for positive mounting of the gear 25 to the shaft 22. The first or primary gear ring 25 includes a relatively thin, radially lobed member arranged to rotate with and to be driven by or drive the shaft 22. The gear 25 provides a plurality of arcuately spaced lobes 25*a* separated by inwardly directed lobe lands 25*b* to evolve a continuous, rounded gear tooth surface which, in combination with the radially adjacent rotor ring 26 will provide a series of expanding and contracting cylinders which act upon or are acted upon by the operative fluid. A modified version of the lobe construction is illustrated in FIG. 7*a* in which the radially outwardly extending lobes are provided of cylindrically shaped rollers 25*f* which are captured for rotation on the extending most portion of each of the teeth 25. Such roller construction and the means for mounting the same are not unique to the art. It should be noted that the applicants have selected a series of seven lobes 25*a* and lands 25*b* to provide a seven toothed ring or primary gear 25 but this selection is purely illustrative.

Immediately adjacent the ring or primary gear 25 are a pair of valve plates 26*a*, 26*b*. These plates 26*a*, 26*b* are generally circular in shape and are provided with an inner passage 26*c* therethrough for engagement for the multisided shaft portion 22*b*. These valving plates then rotate with the ring gear 25. The valve plates 26*a*, 26*b* are each provided with a plurality of valving apertures 26*d* therethrough and the location of such apertures is selected with and provided with the design of the ring or gear 25 to partially underlie one of the extending lobes but to provide fluid communication to a next adjacent cavity. It should be noted that the particular shape of each valving passage is defined by inner and outer arcs and by angular lines and in practice this may vary although minimally. Obviously from the stated and shown geometry, seven such passages are provided in the plates.

Arranged immediately radially outwardly from the ring rotor or gear 25 is an annular, double lobed member 27 which has an inner diameter providing rounded gear teeth with the inner peripheral teeth designated 28*a* and the outer or land portions designate 28*b*. Obviously, these teeth are provided to intermesh with the teeth of the gear rotor to provide a plurality of expanding and contracting chambers and to provide such chambers, as in other gerotor structures, the number of such teeth on the double lobed ring member 27 is one greater than the number of teeth on the ring rotor or gear 25. The diameter and number of relative lobes per each member is well known to the gerotor art and is inherent and specific to the intent of the device.

As illustrated, the ring rotor 27 is also provided with external teeth consisting of the extending lobe portions 29*a* and internal land portions 29*b* to again form rounded tooth portions completely around the periphery of the ring rotor 27. The number of the teeth is again, preselected for application and pressure utilized.

A stationary ring gear 30 surrounds the rotor ring member 27 and such ring gear 30 is provided with internally extending teeth consisting of the inwardly extending tooth portions 30*a* and the radially outward land portions 30*b*. Again, the teeth on the stationary ring 30 is one greater than the teeth on the rotor ring member 27.

As previously described for the rotor ring member, the applicant has considered utilization of roller members on at least the stationary ring member 30 and this concept is illustrated in FIG. 7*a*. As shown therein, a plurality of roller members 30*d* are held by capturing portions 30*c* of the extending teeth elements 30*a* to thus proan actual rolling surface between the various elements. These roller members may selectively be provided on the ring rotor 27 or at the designer's option, all members.

It should be obvious that the rotor ring 27 is of such a size and with the selected variations of teeth between itself and the ring gear 25 and the stationary ring member 30, that it is free to both rotate and orbit within the spacing between the ring gear 25 and the stationary ring 30. As is well known, a single gerotor unit consisting of a rotating and orbiting ring gear or star gear and a stationary ring requires a "dog-bone" connection of the ring gear to the shaft of the unit. Applicant, using the rotor ring 27 as the orbiting member eliminates such a connection as this member may be termed "free-floating" as controlled by the various fluid pressures.

A first valving ring pair 26*a*, 26*b* mounted for rotation with shaft 22 and ring gear 25 has been described.

A second valving ring pair, fixed to the housing 20 and fixed relative to the stationary ring gear 30 is provided and is designated respectively 32*a*, 32*b*. Each of these valves 32*a*, 32*b* consists of a flat plate member and each is provided with valving passages 32*c* equal to the number of lobes in stationary ring 30 directly therethrough and each passage 32*c* is provided with a ramped or canted area 32*d* communicating therewith to insure flow to the resultant area between the rotor ring 27 and the stationary ring member 30. The particular ramping portion appears best in FIG. 4.

A third valving plate is provided for each side of the gerotor assembly and such pair of plates is designated 35*a*, 35*b*. Each plate is provided with an oversized central aperture 35*c* which is of a size to permit both rotation and orbital movement of the same in conjunction with the rotor ring 27. The plates 35*a*, 35*b* are pinned or otherwise connected to ring 27 as by the aperture 35*f* and pin 35*g* combinations. The pins 35*g* are positioned with respect to the first valve plates 26*a*, 26*b* and stationary valve plates 32*a*, 32*b* that they are in the radial gap provided therebetween. Also provided on the plates 35*a*, 35*b* are two sets of radially and arcuately spaced valving apertures 35*d*, 35*e*. These valving passages each include one more passage than that provided on the first valve plate 26*a*, 26*b* at such radial location and one less passage 35*e* than that provided on the valve plates 32*a*, 32*b* at such radial location. These rotational and orbital valving plates 35*a*, 35*b* then may be considered to be master valving plates which move in conjunction with the rotating and orbiting rotor ring 27 and, as such, control the flow to the individual chambers formed by the intermeshing teeth as further controlled by the stationary ring valve 30 and the rotating ring valve 26*a*, 26*b*.

Member 38 consists of a carrier cage 39 and a plurality of roller balls 40 within the carrier with the carrier 39 being substantially crescent shape and the rollers balls 40 increasing in size from the extreme ends of the crescent shaped carrier 39 to center portion thereof. The concept of this member 38 is to offset the unbalancing forces caused by the orbital motion of the rotor ring 27 and the attached valving plates 35*a*, 35*b* and therefore provides a radial thrust bearing member which rotaes within the unit in opposition to ring 27 and valve plates 35*a*, 35*b*. This opposing relation to the combined ring and plates counterbalances the same while providing a radial thrust bearing member. Although shown as a roller-cage combination, it should be ovbious that the form and structure of member 38 may be modified without departing from its intended purpose.

Figure 4:
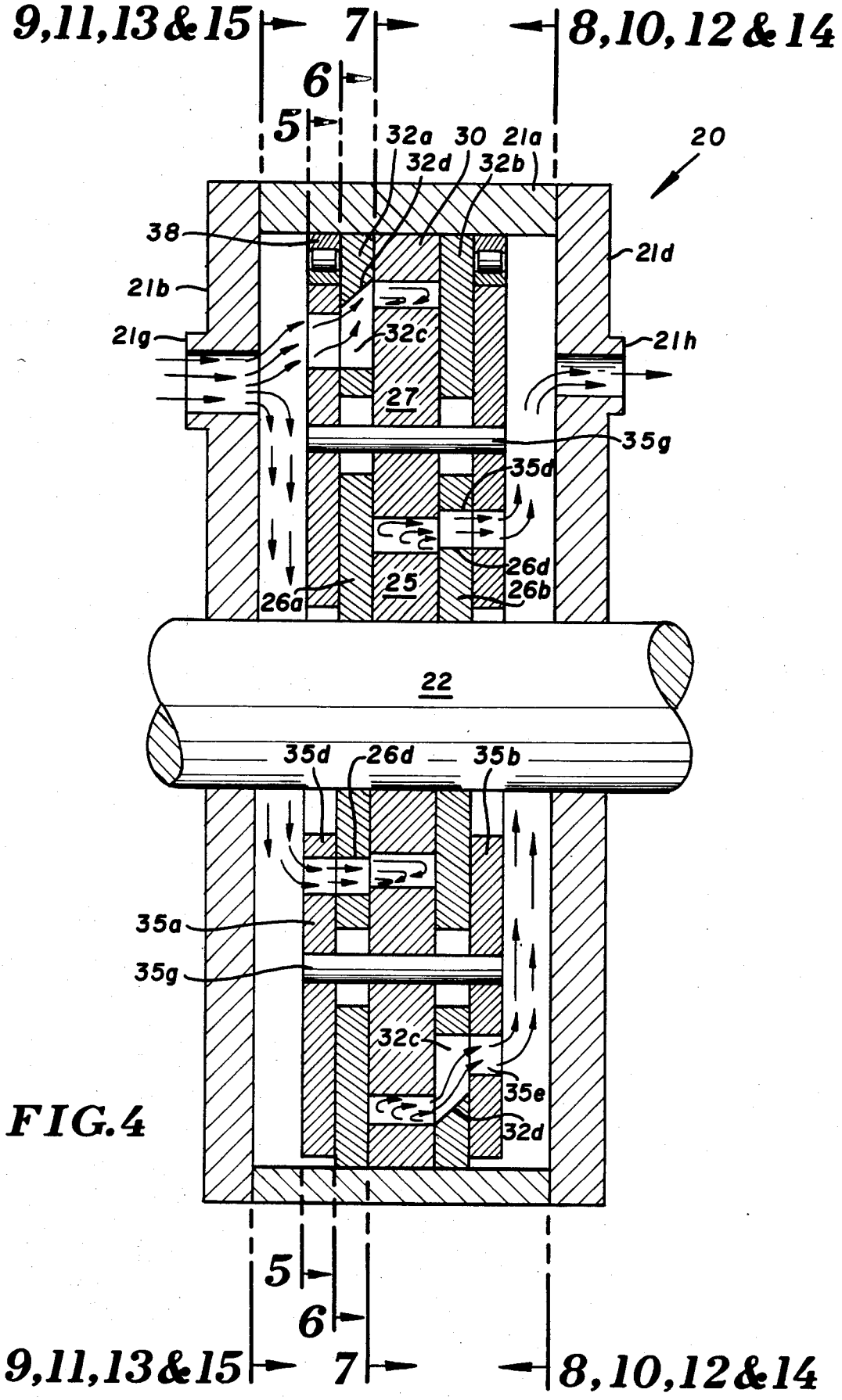
FIG. 4 is a cross section taken substantially along Line 4—4 of FIG. 3.
Figure 5:
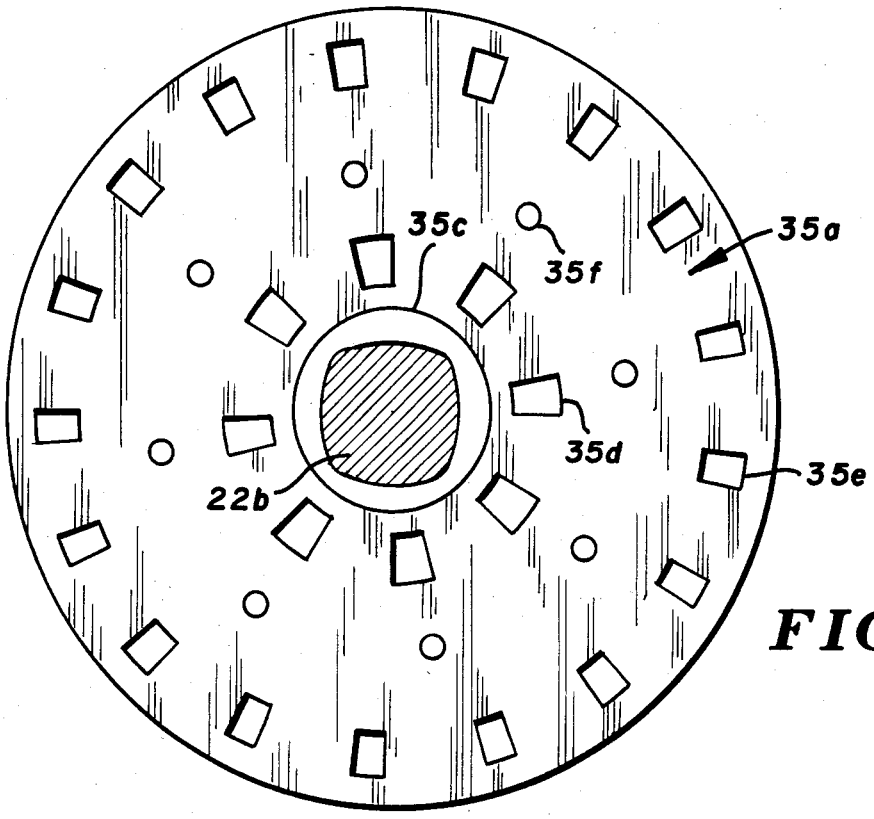
FIG. 5 a cross section taken substantially along Line 5—5 of FIG. 4.
Figure 6:
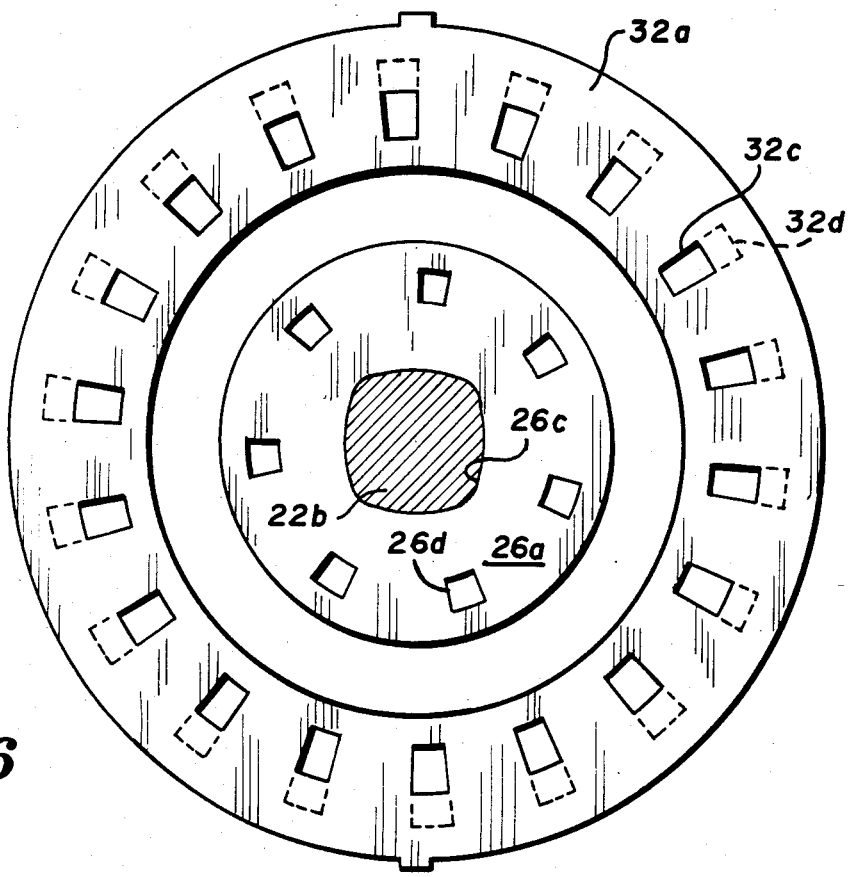
FIG. 6 is a cross section taken substantially along Line 6—6 of FIG. 4.

To this point, all of the elements to provide a radially arranged, double gerotor device, to operate as a fluid-driven rotational-output motor are provided. A typical flow pattern through the unit is illustrated in FIG. 4 and in viewing FIG. 4 it must be taken into consideration that the section shown is not a purely diametric section but is taken along Line 4—4 of FIG. 3 which permits alignment of passages and teeth of the unit. Flow through the unit is shown as two parallel paths one of which is directed to the radially outward set of chambers formed by the stationary teethed ring 30 and the outer teethed periphery of the orbital and rotational rotor ring 27 while the other path is to the radially inward set of chambers formed by the inner periphery of the rotor ring 27 and the teeth of the ring gear 25 of shaft 22. Obviously this motor is reversible simply by reversal of flow therethrough and the sequential operation of the valving is controlled by the valve plate combinations to fill a chamber with fluid thus forcing it circularly which simultaneously causes orbiting motion of the rotor ring and it is this com bined motion between the two sets of chambers which provides for proper rotational power to the output shaft. This parallel arrangement has many beneficial considerations which include the number of power pulses per revolution which lowers torque ripple output and such a unit will hold a load without requiring continued hydraulic pressure. This latter attribute also includes a self braking factor as well as a precise stop-start factor.

The particular locations of the various valving ports and therefore the control of flow from and to the contracting and expanding chambers is illustrated in the sequential views of FIGS. 8 through 15. FIGS. 8, 10, 12 and 14 illustrate the unit as though it were being from the right hand side of FIG. 4 at the view Line designated 8, 10, 12 & 14 and FIGS. 9, 11, 13 & 5 are as though the unit was being viewed from the view Line of 9, 11, 13 & 15 of FIG. 4. This set of views also illustrates shaft 22, ring gear 25, rotor ring 27 and stationary ring gear 30 and, through dotted lines, the inner and outer diameters of the first valve plates 26*a*, 26*b* and the outer stationary valve plates 32*a*, 32*b*. Further shown on the various views in dotted lines are the valving passages 26*d* of the first valve plate and passages and ramped surfaces 32*c*,*d* of the stationary plate and in solid lines, the valving apertures 35*d*, 35*e* of the rotating, orbiting valving plates 35*a*, 35*b*.

The views are arranged with ring positions of 0°, 90°, 180°, and 270° with rotation being clockwise to produce a clockwise output shaft rotation. With the specific selection of seven tooth construction for the gear or ring gear 25, obviously one more for the inner teeth of the rotor ring 27, and 17 for the outer teeth of the rotor ring 27 and thus 18,for the inner teeth of the stationary ring 30, there will be a total of 17 shaft rotations and 119 orbital shifts for the rotor ring 27 before the valving arrangement returns to the position of that shown in FIG. 8 or FIG. 9. As these views show the particular elements and their relative positions through one shaft rotation, 0 and 360 shaft positions being identical at least for the ring gear and carried plate, it is not thought that it is necessary to detail the opening and closing of the various flow passages in response to rotation and orbital movement.

The utilization of the applicant's various concepts such as the radial tandem positioning, the plate valving which not only reduces total size but provides for straight through valving, dissimilar valving surfaces for the intake and exhaust valves accompanied with larger sealing lands to prevent leakage and cross porting all provide for high volumetric efficiency. The simplicity of three valve plates to control inlet and outlet respectively and simple three piece duplex gerotor construction all must be considered in comparing the uniqueness of the applicant's design. The simplicity also results in a wide selection for independent displacements of the gerotor elements, particularly of the inner and outer rings and simple length modifications. All of these factors are of considerable merit when comparing the applicant's unit to the prior art.

Figure 16:
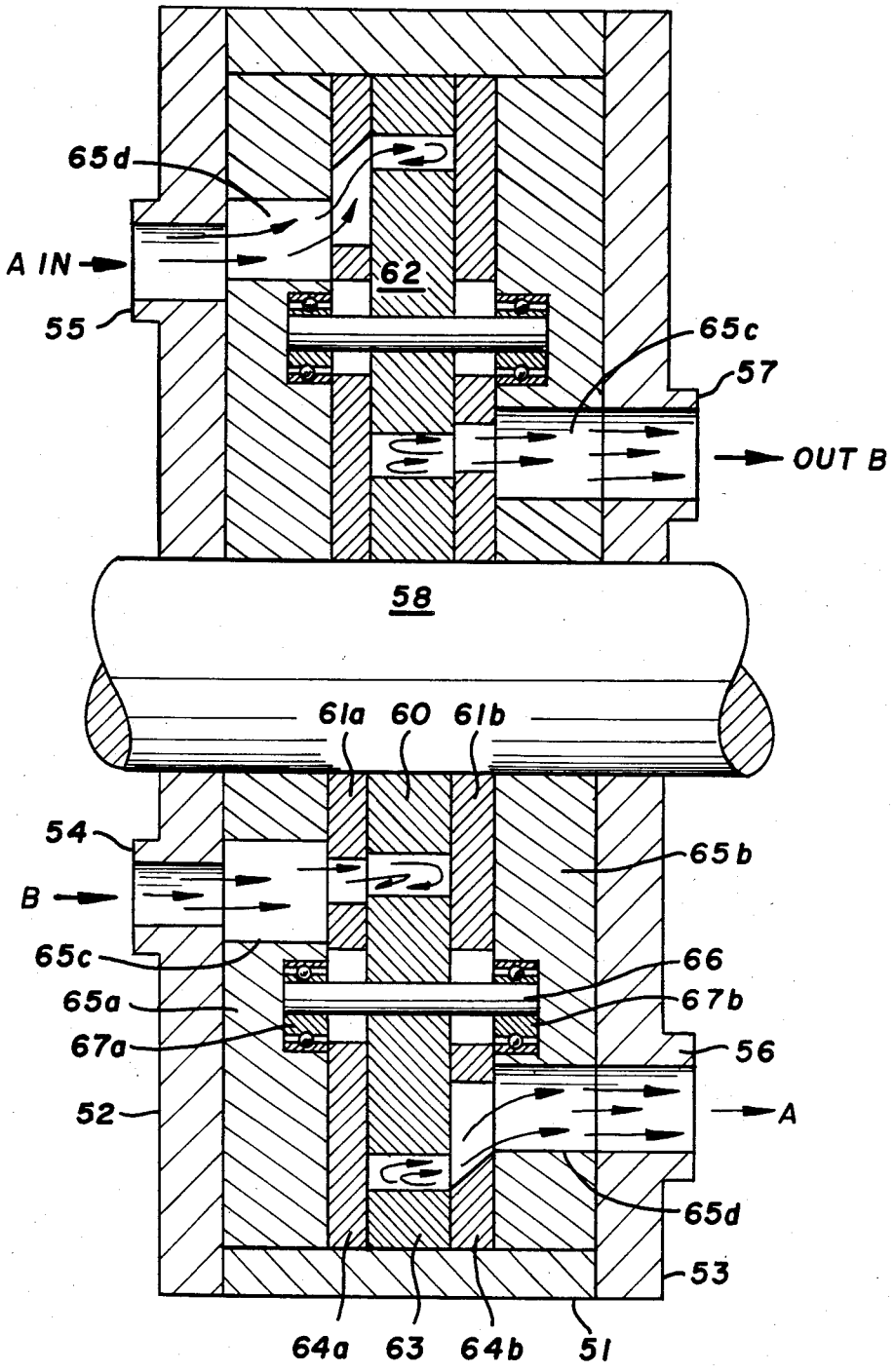

Applicants' unit has utilization and may function as a combination motor-pump wherein fluid power is utilized and converted to rotary power for the pumping of a second liquid. This particular use is illustrated in FIG. 16. In this form of the invention, fluid under pressure is being delivered to the outer set of chambers and the inner set of chambers is being utilized for pumping another fluid. In such a choice, there would be a low mass flow and high pressure rise on the inner chamber set while, if the unit were operated in a reverse or fluid supplied to the inner set of chambers condition with the outer doing the pumping, the resultant would be a high mass flow and low pressure rise on the pumped fluid of the outer chamber set.

In this form, a housing 51, end plates 52, 53 with inlets and outlets 54, 55, 56 and 57 is provided and a shaft 58 is mounted for rotation within the housing 51 and shaft 58 would serve no other purpose than as a mounting for rotation of the gerotor assembly and alignment thereof.

Inlet 54 may be termed an inner member inlet as it provides inlet flow to the inner set of lobes or teeth as exist between ring gear 60 and rotor ring 62 with the outlet 57, termed an inner member outlet for the exhaust of fluid from such area. Inlet 55 may similarly be termed an outer member inlet as it provides inlet flow to the outer set of lobes or teeth as exist between rotor ring 62 and stationary ring 63 with the outlet 56 termed an outer member outlet for the exhaust of fluid from such area.

The basic gerotor assembly would again include the ring gear 60 having a pair of valving plates 61*a*, 61*b* carried therewith, a rotor ring 62 capable of and placed and sized for rotational and orbital movement and the stationary assembly consisting of stationary ring 63 and stationary valve plates 64*a*, 64*b*. The only required variation to operate the applicants' unit as a motor-pump is the elimination of the orbiting movement of the plate vlaves 65*a*, 65*b* carried by the rotor ring 62. Each of the valving plates 65*a*, 65*b* are provided with valving apertures, the inner designated 65*c* and outer 65*d*, as illustrated and positioned on FIG. 5 Obviously as this set of plates does not orbit with the rotor ring 62, it may serve as a commutator for flow distribution from and to the two inlets and two outlets while preventing flow therebetween.

If it is necessary to eliminate the orbital motion of the rotor ring 62 from the plates 65*a*, 65*b*, this may be simply achieved. As illustrated, a connective pin 66 is provided to connect the plates 65*a*, 65*b* and rotor ring 62 and this pin is received into openings of the plates 65*a*, 65*b* which openings are of a diameter twice the eccentricity of the rotor ring in its orbital path or, to eliminate wear, a pair of bearings 67*a*, 67*b* having offset pin receiving passages may be provided to receive the pins and complete the connections between units. The offset would be twice the orbiting eccentricity and thus the only driving effect resultant to the two valve plates 65*a*, 65*b* would be circular. For this reason, it is possible to make the plates circular in shape to eliminate the radial thrust bearing member of FIG. 4.

As the valve plates 65*a*, 65*b* are circular, and they only rotate and therefore do not present any unbalanced forces and therefore do not require radial thrust bearing as described and illustrated in the first form of the invention.

As stated, shaft 58 serves only a centering and rotation function in this form and therefore a complete shaft structure is not required. It should also be obvious that shafts, as stated, may be of any form to allow attachment of other units, mounting and other functions or services.

One simple and obvious use is available from the applicants' basic concept and its modification thereof to form a motor-pump combination. With the form shown in FIG. 16, a metering function may be performed wherein the supplied fluid is the controlling factor in the addition of other fluids to the final output. For example, a fluid supplied, which requires an additive is utilized as the power source to the set of chambers which will act as the motor and is admitted to the proper inlet 54 or 55. Fluid is then made available to the set of chambers that will act as the pump through the other 54 or 55 inlet. The output is then joined in the correct mixture through connection of outlets 56, 57. It should be obvious that such metering may be selective by varying chamber sizes of the gerotor arrangement and all resultant flow will be properly metered as additive flow is controlled by supplied flow of fluid.

It should be obvious that the applicant has provided a new and unique, what may be termed a double, duplex or similar terminology, gerotor device which incorporates all of the aspects of normal gerotors but which provides an improved and fluidically and economically feasible structure.

What is claimed is:

1. A rotary motion fluid device including:

a. a fluid retaining housing having at least a fluid inlet and a fluid outlet;

b. a first gear member arranged for rotation within said housing and providing an outer peripheral surface defining a plurality of gear teeth thereon;

c. a first pair of valving plates arranged on opposite sides of said gear member and for rotation with said gear member and each having a plurality of flow passages therethrough for the inlet and exhaust of fluid from areas defined by said teeth of said gear;

d. a stationary ring gear member arranged interiorally of said housing and being radially spaced from said first gear member and providing an inner peripheral surface defining a plurality of gear teeth thereon;

e. a pair of stationary valving plates arranged on opposite sides of said stationary ring gear and having each having a plurality of flow passages therethrough for the inlet and exhaust of fluid from areas defined by said teeth of said gear;

f. a rotor ring gear arranged intermediate said first and said stationary gear members and providing an inner and outer peripheral surface, each such surface defining a plurality of gear teeth thereon, the diametric dimension of said ring gear permitting both orbital and rotational movement within the area defined between said first gear member and said stationary gear;

g. said inner and outer teethed surfaces of said rotor ring gear and the respective teeth of said first gear member and said stationary gear member providing a plurality of expanding and contracting chambers as relative motion exists therebetween upon flow of fluid through said housing;

h. a pair of valveplates arranged on opposite sides of said rotor ring and moveable therewith, each of said rotor valveplates providing a first set of valving passages defined therethrough in a radial position to communicate with said flow passages of said pair of first valving plates and a second set of valve passages defined therethrough in a radial position to communicate with said flow passages of said stationary valve plates; and, i. means for introducing fluid under pressure to said housing inlet for distribution to the chambers defined by said rotor ring, said stationary ring and said gear member to produce rotation of said first gear member.

2. The rotary motion fluid device as set forth in claim 1 and said first gear member being provided with an output shaft for the transfer of mechanical rotary motion from the device.

3. The rotary motion fluid device as set forth in claim 1 and;

a. the number of the defined teeth on the inner periphery of said rotor ring being one more than the number of teeth defined on said first gear member; and b. the number of valving passages provided in said first set of valving passages of said rotor ring being one more than the number of valving passages of said flow passages of said first pair of valving plates adjacent said first gear member.

4. The rotary motion fluid device as set forth in claim 1 and;

a. the number of the defined teeth on the outer periphery of said rotor ring being one less than the number of teeth defined on said stationary ring gear; and, b. the number of valving passages provided in said second set of valving passages of said rotor ring being one less than the number of said flow passages of said pair of stationary valving plates adjacent said stationary ring gear.

5. The rotary motion fluid device as set forth in claim 1 and;

a. the number of the defined teeth on the inner periphery of said rotor ring being one more than the number of teeth defined on said first gear member;

b. the number of valving passages provided in said first set of valving passages of said rotor ring valve plates being one more than the number of valving passages of said flow passages of said first pair of valving plates adjacent said first gear member;

c. the number of the defined teeth on the outer periphery of said rotor ring being one less than the number of teeth defined on said stationary ring gear; and, d. the number of valving passages provided in said second set of valving passages of said rotor ring being one less than the number of said flow passages of said pair of stationary valving plates adjacent said stationary ring gear.

6. The rotary notion fluid device as set forth in claim 1 and;

a. the outstanding teeth as defined by at least one of said teethed surfaces being round in longitudinal configuration.

7. The rotary motion fluid device as set forth in claim 1 and each of the teeth of each the members being round gear teeth.

8. the rotary motion fluid device as set forth in claim 1 and at least selected of the gear teeth of the individual members of said device including means for retaining a roller member at the outermost extent thereof whereby said rollers defines the profile of the tooth.

9. The rotary motion fluid device as set forth in claim 1 and a radial thrust bearing member arranged in radial relation to said rotor ring valving plates and shiftable therewith to offset the eccentric motion and forces due to orbital movement of said rotor ring and attached valve plates.

10. the rotary motion fluid device as set forth in claim 1 and said rotor ring normally moving in an orbital and rotating path between said first gear member and said stationary ring gear, and, a. means connectively joining said pair of rotor ring valve plates to said rotor ring to limit the motion of said valve plates whereby said valve plates are limited to rotary motion.

11. The rotary motion fluid device as set forth in claim 10 and;

a. said housing providing at least a pair of inlets and a pair of outlets for fluid flow to and from the contained structure;

b. means for directing the fluid from a first of said inlets to a first selected one of said valving passages in said rotor ring valve plates;

c. means for directing the fluid from the second of said inlets to a second selected one of said valving passages in said rotor ring valve plates; and, d. means for selectively receiving the exhaust from said housing.

* * * * *